US007887055B2

(12) United States Patent
Gardner

(10) Patent No.: US 7,887,055 B2
(45) Date of Patent: Feb. 15, 2011

(54) LOGIC AND MATHEMATICAL PUZZLE

(76) Inventor: Douglas Daniel Gardner, 4626 N. 23rd St., Arlington, VA (US) 22207

( * ) Notice: Subject to any disclaimer, the term of this patent is extended or adjusted under 35 U.S.C. 154(b) by 101 days.

(21) Appl. No.: 12/251,294

(22) Filed: Oct. 14, 2008

(65) Prior Publication Data

US 2010/0252993 A1 Oct. 7, 2010

(51) Int. Cl.
*A63F 9/00* (2006.01)

(52) U.S. Cl. ..... 273/153 R

(58) Field of Classification Search ..... 273/153 R, 273/157 R, 156, 272, 302; 434/188, 191
See application file for complete search history.

(56) References Cited

U.S. PATENT DOCUMENTS

| | | | | | |
|---|---|---|---|---|---|
| 487,798 | A * | 12/1892 | Thurston | 273/156 |
| 943,435 | A * | 12/1909 | Maris | 273/273 |
| 1,121,697 | A | 12/1914 | Weil | |
| 3,403,460 | A * | 10/1968 | Barrows | 273/157 R |
| 3,460,835 | A * | 8/1969 | Crans | 273/153 R |
| 3,547,444 | A * | 12/1970 | Williams et al. | 273/157 R |
| 3,592,474 | A * | 7/1971 | O'Neil | 273/157 R |
| 3,966,209 | A * | 6/1976 | Gambardella | 273/153 R |
| 4,419,081 | A * | 12/1983 | Steinmann | 434/188 |
| 4,463,952 | A * | 8/1984 | Rowbal | 273/156 |
| 5,743,741 | A * | 4/1998 | Fife | 434/188 |
| 6,619,661 | B1 * | 9/2003 | Collins | 273/157 R |
| 2007/0176362 | A1 * | 8/2007 | Hohenstein et al. | 273/260 |
| 2007/0210516 | A1 * | 9/2007 | Bohac | 273/153 R |
| 2008/0084025 | A1 * | 4/2008 | Oliphant | 273/153 R |
| 2008/0174069 | A1 * | 7/2008 | Ouellet | 273/272 |
| 2008/0203659 | A1 * | 8/2008 | Cabrera | 273/153 R |
| 2009/0091079 | A1 * | 4/2009 | Lyons, Jr. | 273/153 R |
| 2009/0096160 | A1 * | 4/2009 | Lyons, Jr. | 273/153 R |
| 2009/0160131 | A1 * | 6/2009 | Chen | 273/272 |
| 2009/0198576 | A1 * | 8/2009 | Rogers, Jr. | 273/153 R |

OTHER PUBLICATIONS

Will Shortz, Sun, Surf, and Sudoku (Book), Jun. 2008, "How to Solve a Sudoku", (3 pages, no page numbers). Printed in the USA, published by St. Martin's Griffin.

Conceptis Puzzles, Brown Belt Kakuro (Book), 2006, pp. 3-6. Printed in the USA, published by Sterling Publishing Co.

M.S. Moayeri, Diagonal Jigsaw Sudoku (Book), 2008, pp. 7-9. Printed in the USA, published by Sterling Publishing Co.

* cited by examiner

*Primary Examiner*—Steven Wong

(57) ABSTRACT

An improved puzzle of the type that requires an examinee to fill a geometric grid with indicia using a set of clues and guided by placement rules, comprising a plurality of geometric shapes arranged contiguously to form rows, columns, diagonals, and spaces where the geometric shapes intersect. The placement rules of an embodiment are to fill the geometric shapes with non-repeating indicia such that indicia are also not repeated in any row, column, diagonal, or geometric shape. Clues are provided by the examiner in the form of a predetermined subset of the solution indicia, aggregation information about the indicia in each diagonal, and aggregation information about the indicia bordering areas where the geometric shapes intersect. This construct provides a superior challenge for the examinee by increasing the number and types of techniques required to solve a puzzle instance.

8 Claims, 7 Drawing Sheets

Dashed lines represent linear constructs 380 (rows, columns, and diagonals) of integer numbers 100

Aggregated information 390 is the composite description of diagonals sums 360 and diamond sums 370

Numbers for specific positions where Integer Numbers 100 can be placed within an octagon Ordered Pairs are reference numbers for identifying octagons 120

Dashed lines - - · - · - · represent linear constructs 380 (rows, columns, and diagonals) of integer numbers 100

Aggregated information 390 is the composite description of diagonals sums 360 and diamond sums 370

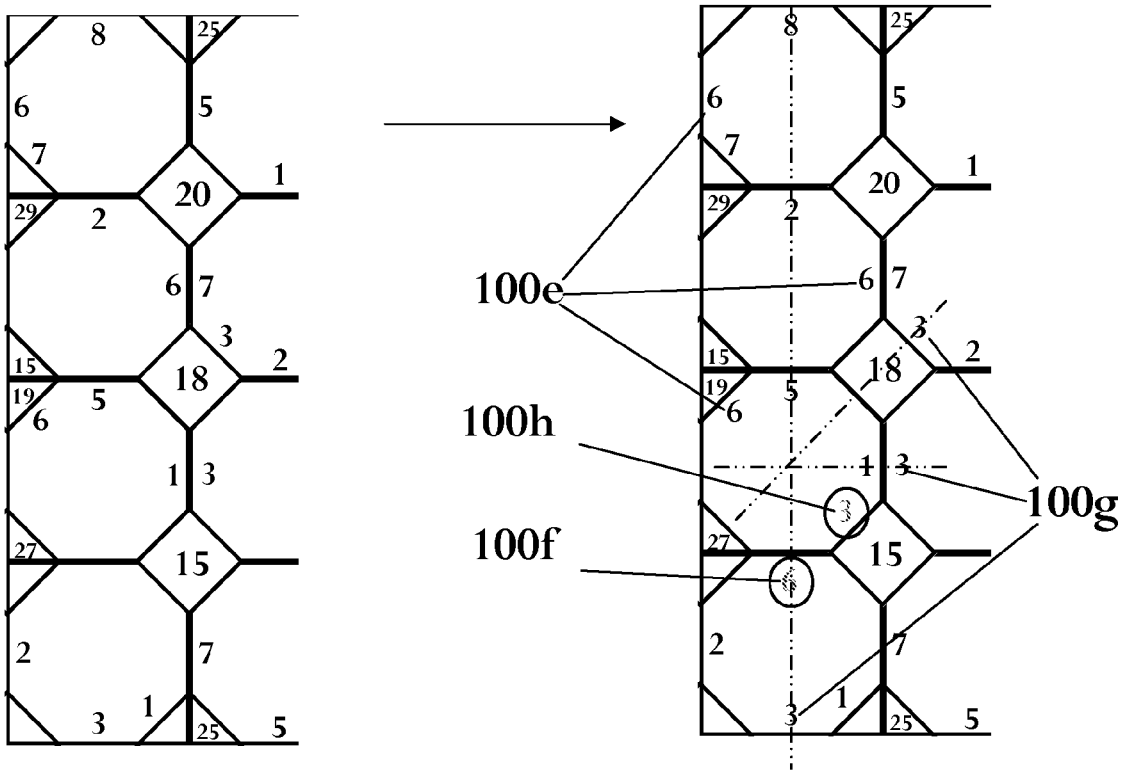
Fig. 7(a)
Fig. 7(b)
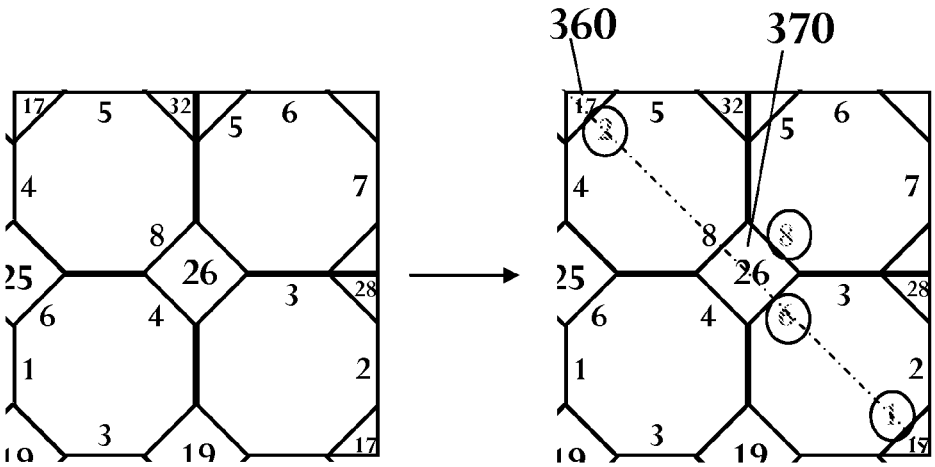
Fig. 8(a)
Fig. 8(b)

LOGIC AND MATHEMATICAL PUZZLE

CROSS REFERENCE TO RELATED APPLICATIONS

Not Applicable

FEDERALLY SPONSORED RESEARCH

Not Applicable

SEQUENCE LISTING OR PROGRAM

The complete program listing of the first embodiment of the current invention are included as an appendix to this application. The sequence listing was created using the Microsoft Visual Basic 2008 Express Edition development environment, originally downloaded 10 Dec. 2007. The appended program listing referenced in the following specification is the file titled "Program_Listing-Gardner.txt" and is 49 Kb in size.

BACKGROUND OF THE INVENTION

1. Field of Invention

This invention generally relates to puzzles, more specifically to that class of puzzles wherein the object is to fill in a geometric structure with indicia using provided clues and guided by placement rules.

2. Background of the Invention

Puzzles requiring the placement of numbers or symbols in a predetermined grid based on clues and guided by placement rules are common in the prior art. The present invention uniquely combines concepts previously implemented in the following three puzzles—Sudoku, Kakuro, and U.S. Pat. No. 1,121,697 to Weil (1914). The background and limitations for each of these prior art references will be addressed in the following paragraphs:

SUDOKU puzzles are well known in the prior art. Sudoku puzzles are logic puzzles that generally use numbers and a square grid (usually nine-by-nine squares). In its most common form, Sudoku groups the squares into nine boxes, each containing a three-by-three grid of squares. Clues are provided in the form of examiner-selected squares which are prefilled with correctly placed numbers. The goal of Sudoku is, given only the provided clues, to fill in the entire grid so the numbers 1 through 9 appear just once in every row, column, and three-by-three box.

Sudoku is wildly popular, but it's solving techniques are limited to those that rely only on positional logic, that is, correct answers are resolved based on the relative positions of previously determined numbers within the puzzle grid. For example, if a number '5' is already placed in the grid, the number '5' cannot be placed again in the same row or same column. There is no arithmetic required—in fact, it makes no difference whether numbers or any other unique symbols are used as indicia.

Another limitation is that Sudoku does not work with the diagonals formed by the grid. All attention in the puzzle is focused only on rows, columns, and three-by three square grids.

KAKURO puzzles are also known in the prior art. Kakuro puzzles are mathematical puzzles that are very similar to traditional crossword puzzles except numbers are used rather than letters and the only clues provided are the arithmetic sum of the integers in each row or column. The fundamental defining rule for Kakuro is that no integer is allowed to be repeated in any row or column. The goal of Kakuro is to fill in an entire crossword-like grid structure given only the sums for the rows and columns.

Kakuro puzzles are also very popular, but their solving techniques are limited to unique arithmetic summing—techniques that rely on excluding possibilities based on the fixed number of valid numerical combinations of the digits 1 through 9. For example, if the puzzle shows that the numbers in the two squares of a given row must add up to the number "4", the solution numbers must by "1" and "3" ("2" and "2" is not acceptable because duplicate numbers are not allowed). It cannot yet be determined which square holds the "1" and which square holds the "3"—that information must be determined using the same process against the appropriate columns. However, the initial clue leads to the elimination of 7 of the 9 possible integers. Kakuro puzzles do not rely on positional logic directly. Although it is possible to narrow possibilities based on relative locations in the puzzle grid, the only way to confirm the location of a potential integer is to ensure it sums correctly in the appropriate row and column.

Kakuro shares the limitation described for Sudoku in that it does not recognize the diagonals that are formed by the crossword grid.

The puzzle patented in 1914 by Weil (U.S. Pat. No. 1,121,697) described a 3 by 3 grid of squares with positions for numbers in the corners of each square. Examinees are asked to place the integers 1 through 4 in the corner positions of each square (without repetition within each square) such that the sums of the rows, columns, and diagonals all add up to fifteen.

Weil's puzzle introduces two components that I have incorporated into the present invention. The first is the inclusion of major diagonals as an additional defining component of the puzzle (although Weil's puzzle did not extend to using the shorter diagonals as potential clue sources or puzzle constraints). The second technique I incorporated from Weil is to allow, in certain instances, repetition of numbers when adding them together to form given sums. Allowing multiple (up to 2) "1"s, "2"s, "3"s, or "4"s significantly increased the number of possible valid solution sets, thus increasing the complexity of the resulting puzzle.

The primary limitation of Weil's puzzle, from the perspective of the present invention, is that he did not consider the value of expanding the basic structure of his puzzle beyond squares as the basic building block. The first embodiment of the present invention demonstrates significant advantages in terms of increasing the number of techniques required to solve a placement puzzle by applying the fundamental ideas of Weil's invention to a grid of octagons and introducing additional clues based on the minor diagonals and the diamonds formed by the intersection of the octagons.

SUMMARY

The present invention substantially departs from the more limiting designs and concepts of the prior art by incorporating all of the following solving techniques:

(a) Positional Logic, applied simultaneously within geometric shapes, rows, columns, and diagonals. This technique requires the examinee to consider whether the placement of an integer in a certain position of the puzzle grid will repeat that integer in the corresponding octagon, row, column, and/or diagonal.

(b) Unique arithmetic summing. This technique allows the examinee to reduce the possibilities for a given solution integer based on the limited number of valid integer combinations that add up to the clue, with no addend repetition.

(c) Non-unique arithmetic summing. This technique requires the examinee to determine a combination of four integers that add up to the clue, when it is possible that the integers being added may be repeated. As a lone technique, this is generally not very helpful, because the number of combinations is usually substantial. However, when this technique is combined with other techniques, it becomes an additional novel and challenging technique.

Improving the variety of techniques available to an examinee for solving a puzzle makes the puzzle more interesting, challenging, and fun. The first embodiment of the present invention meets this goal while also introducing a novel physical structure that is easy to automate, facilitating the generation of millions of unique instances of this type of puzzle, presented in a wide variety of difficulty ranges.

In accordance with one embodiment, the present invention provides a superior new form of puzzle that combines the basic concepts of key puzzles available in the prior art to form a more broadly challenging puzzle that requires a wider variety of techniques to solve

DRAWINGS

Figures

The invention will be better understood when consideration is given to the following detailed description thereof. Such description makes reference to the annexed drawings wherein.

Figure 2:
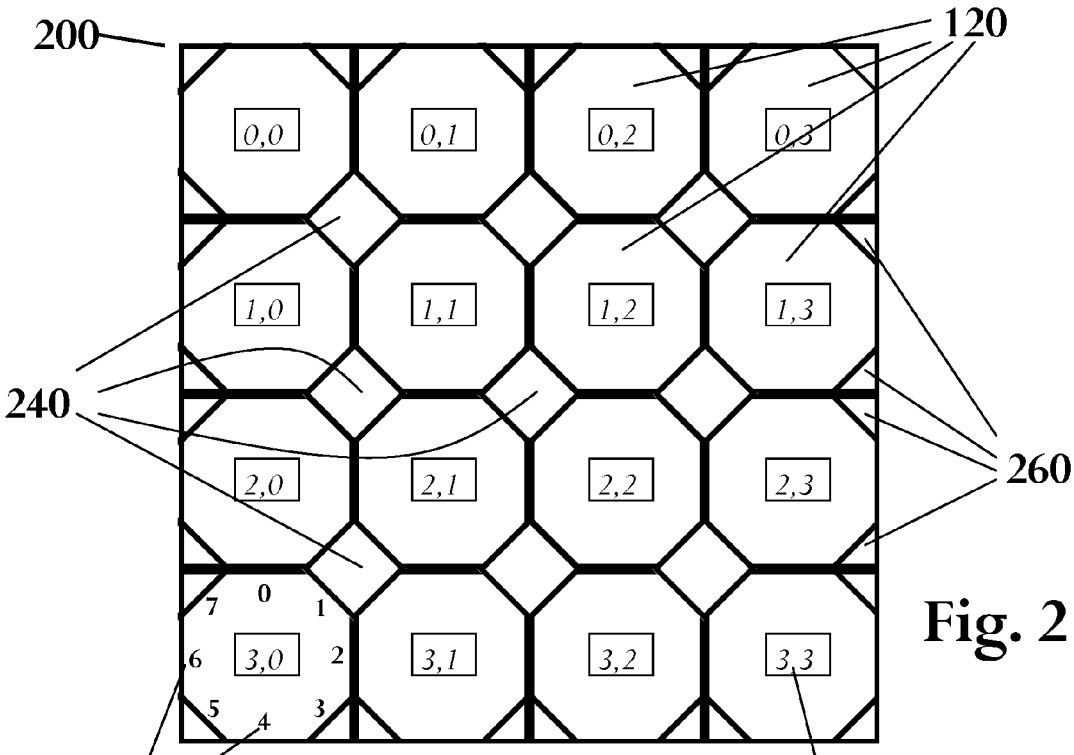
FIG. 2 is a view of the physical structure of the first embodiment of the present invention, showing a four-by-four grid of octagons and the physical relationships created by that construction.
Figure 3:
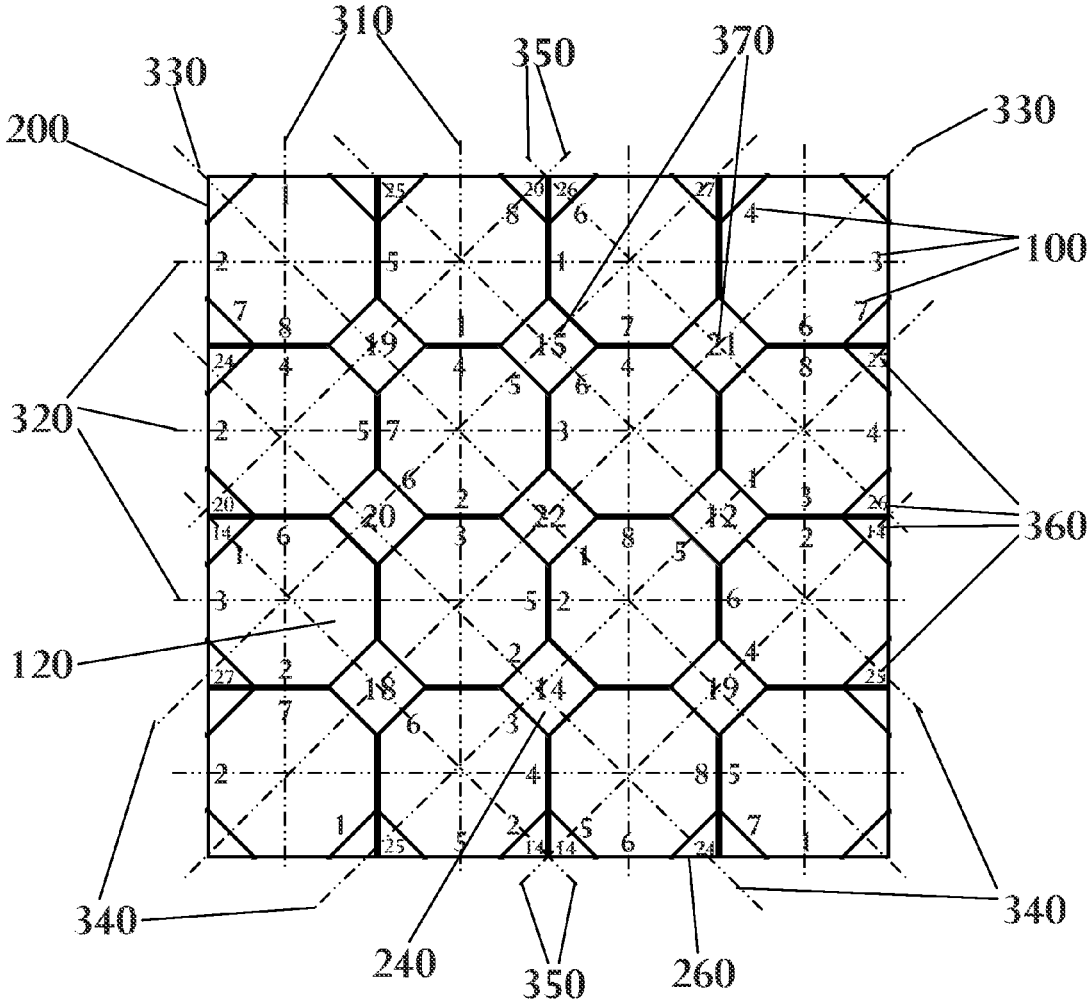

FIG. 3 expands on FIG. 2 by introducing and identifying the types of clues provided to help the examinee solve the first embodiment of the present invention.

Figure 4A:
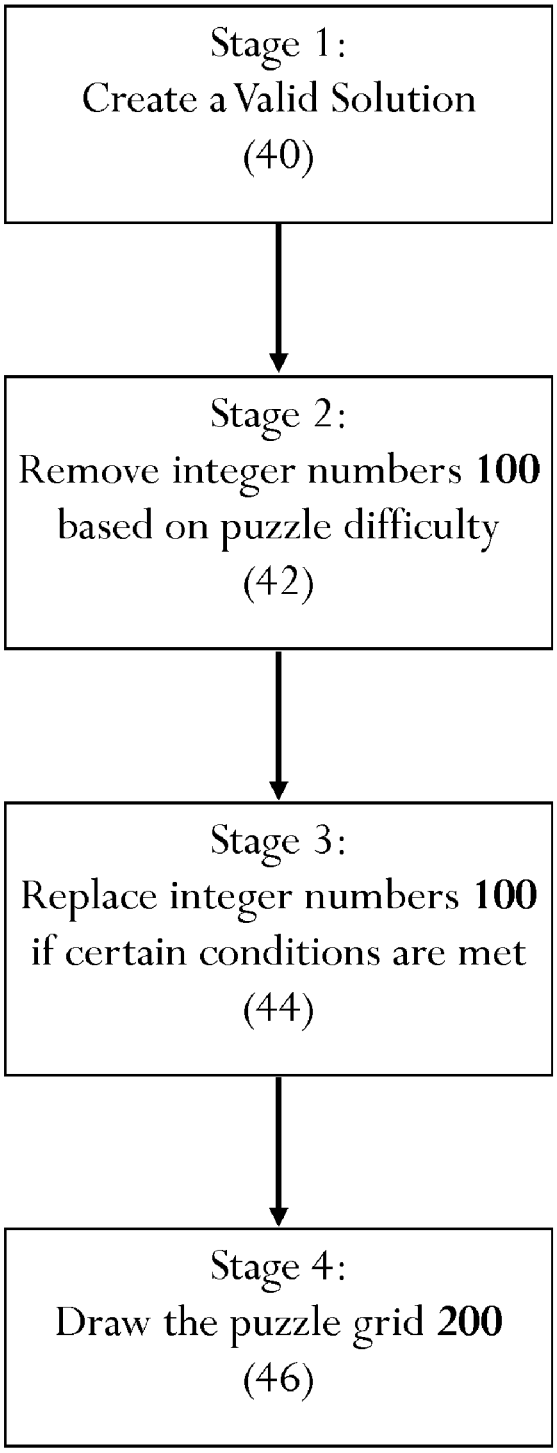
Figure 4B:
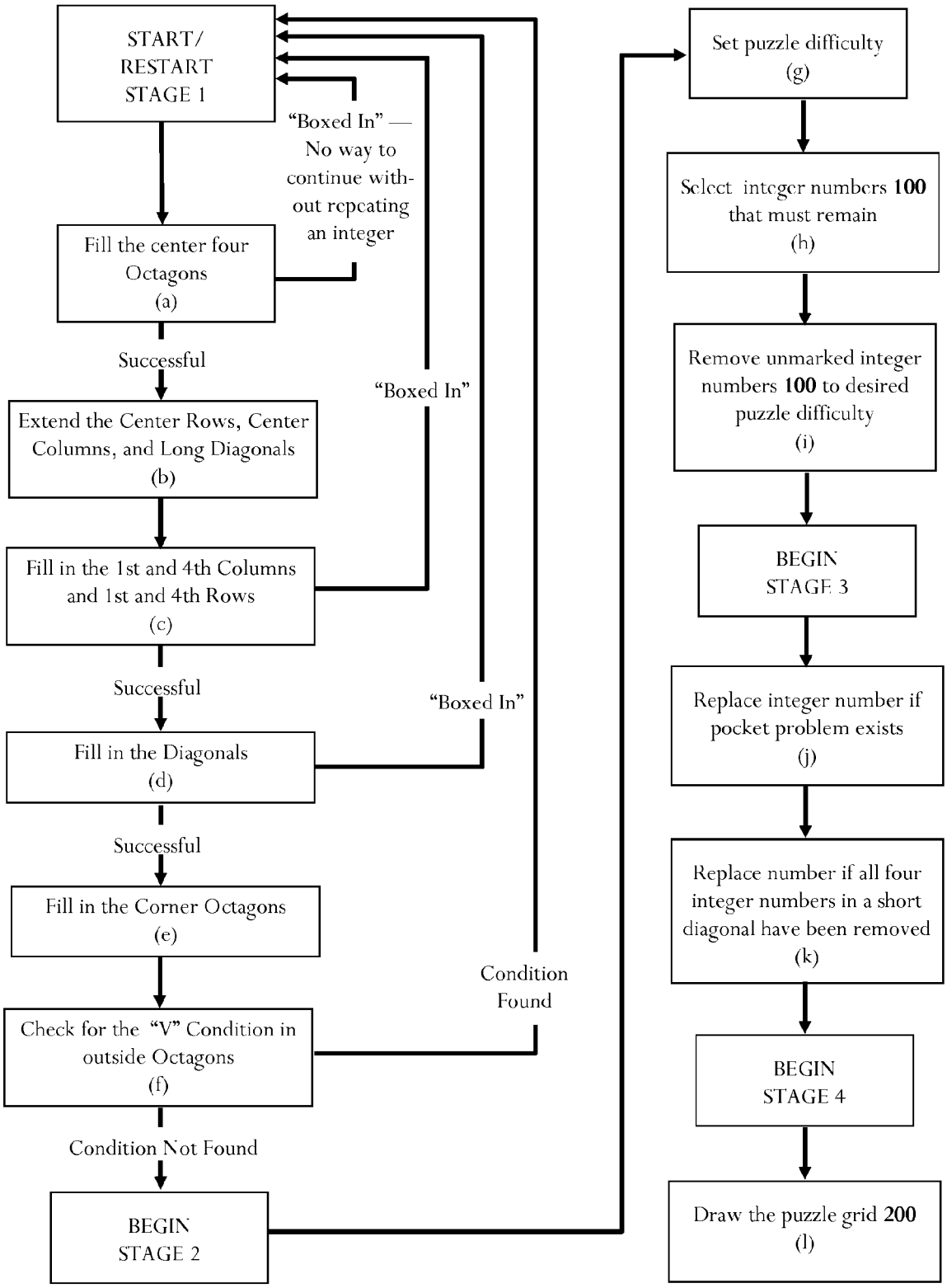

FIG. 4(*a*) is a general flowchart of the steps required to create a valid instance of the first embodiment of the present invention.

FIG. 4(*b*) is a specific flowchart of the detailed steps required to create a valid instance of the first embodiment of the present invention.

Figure 5:
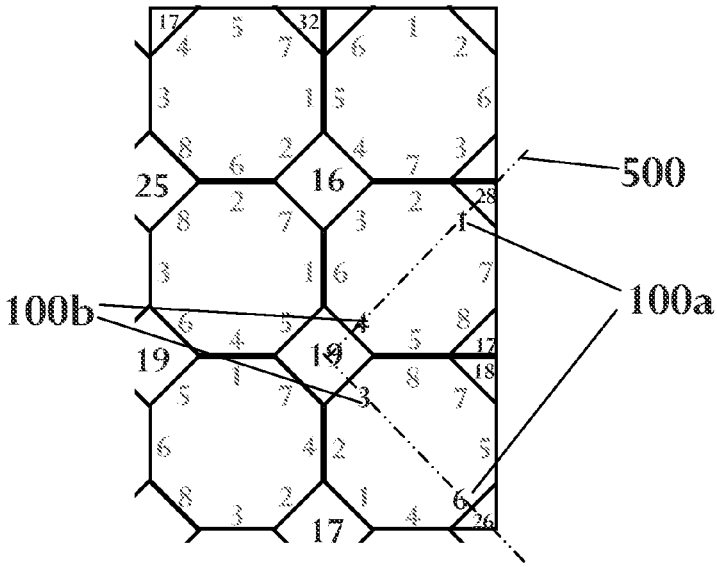

FIG. 5 illustrates the "V" anomaly

Figure 6:
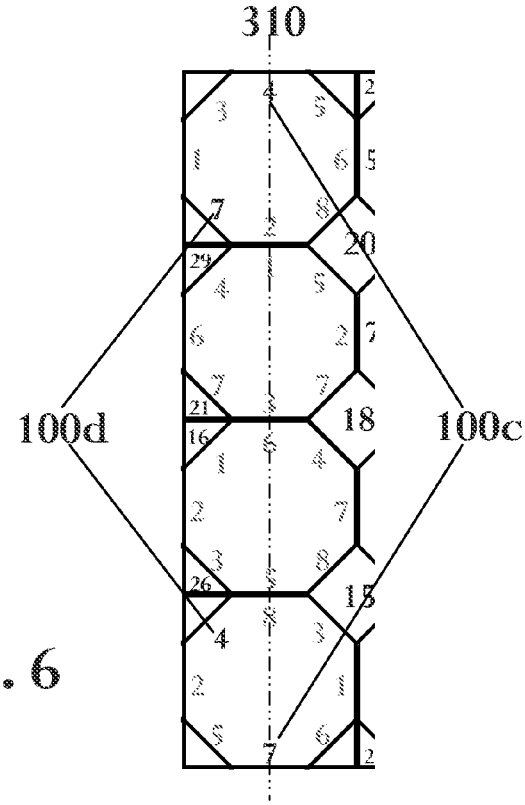

FIG. 6 illustrates the "pocket problem"

Figure 9:
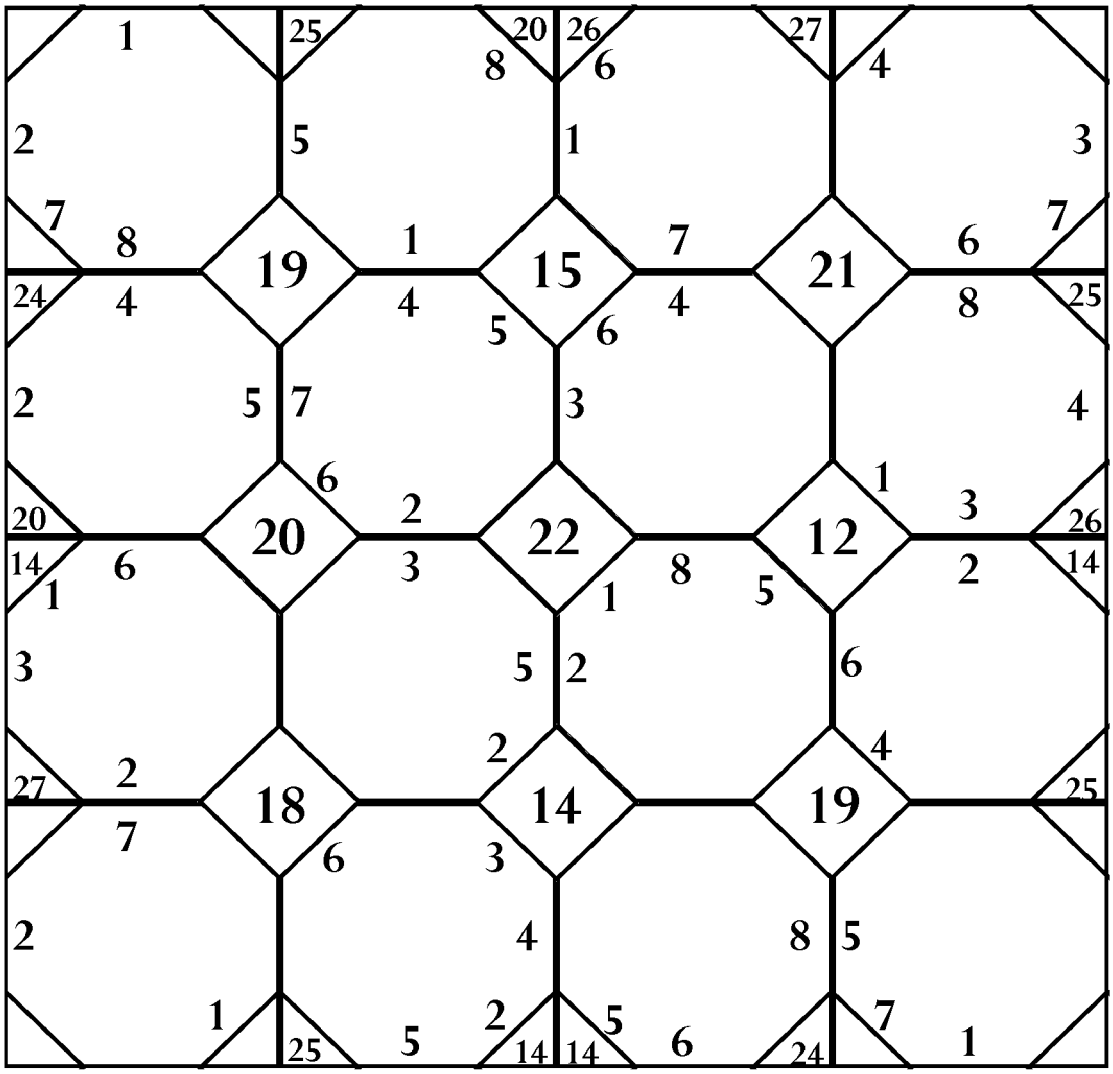

FIGS. 7(*a*) and 7(*b*) illustrate two positional logic solving techniques FIGS. 8(*a*) and 8(*b*) illustrate how clues can be combined to solve a portion of a puzzle FIG. 9 is a complete instance of the first embodiment of the current invention, as it would be presented to an examinee

| DRAWINGS—REFERENCE NUMERALS | |
|---|---|
| 100 | integer number (1-8) |
| 120 | octagon |
| 200 | puzzle grid |
| 240 | diamond |
| 260 | triangle |
| 310 | column |
| 320 | row |
| 330 | long diagonal |
| 340 | medium diagonal |
| 350 | short diagonal |
| 360 | diagonal sum |
| 370 | diamond sum |

-continued

| DRAWINGS—REFERENCE NUMERALS | |
|---|---|
| 380 | linear constructs |
| 390 | aggregated information |
| 500 | the four-number "V" |
| 100a | outside integer numbers of the "V" |
| 100b | inside integer numbers of the "V" |
| 100c | integer numbers sharing a column 310 |
| 100d | matching integer numbers in corner diagonals |
| 100e | three "6"s that determine the placement of a fourth "6" |
| 100f | the correctly deduced placement of a "6" in the column 310 |
| 100g | three "3"s that determine the placement of a fourth "3" |
| 100h | the correctly deduced placement of a "3" in the octagon 120 |

DETAILED DESCRIPTION OF THE FIRST EMBODIMENT

FIGS. 1-6

The present invention is described for the first embodiment and accompanying drawings. It should be appreciated that this embodiment is merely used for illustration. Although the present invention has been described in terms of a first embodiment, the invention is not limited to this embodiment. The scope of the invention is defined by the claims. Modifications within the spirit of the invention will be apparent to those skilled in the art.

Figure 1:
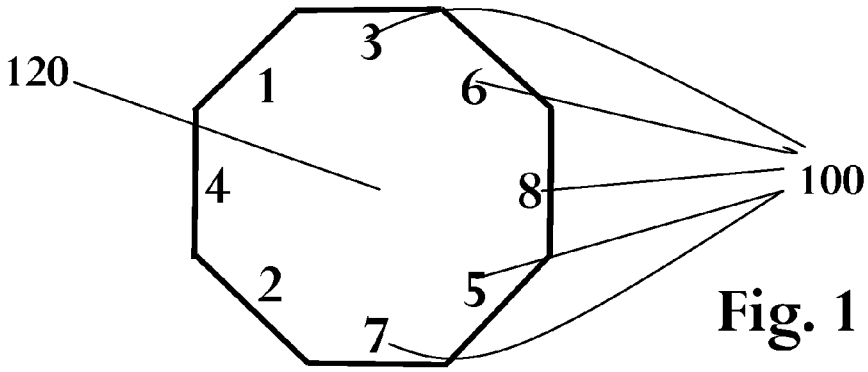
FIG. 1 shows how integer numbers (1-8) are placed in an octagon

With reference now to the drawings, and in particular to FIGS. 1 through 3, a construct for a puzzle embodying the principles and concepts of the present invention and generally designated by the reference number will be described.

FIG. 1 shows how an integer number (1-8) 100 is arranged in each of the octagons 120. The ordering of the integer numbers 100 in FIG. 1 is for example purposes only, integer numbers 100 can occur in an octagon in any combination that does not repeat an integer number 100.

FIG. 2 is a view of the physical structure of the first embodiment of the present invention, showing a four-by-four grid of octagons and the physical relationships created by that construction. As illustrated by FIG. 2, the first embodiment of the present invention comprises a puzzle grid 200. The puzzle grid has sixteen octagons 120 contiguously arranged in a four-by-four pattern. The intersection of four octagons forms a diamond 240. At the edges of the puzzle grid 200, bisecting the area between where two octagons 120 meet, two triangles 260 are formed.

FIG. 3 is a depiction of the first embodiment of the present invention. The construction of this embodiment creates linear constructs 380, specifically four columns 310 of eight integer numbers 100, four rows 320 of eight integer numbers 100, two long diagonals 330 of eight integer numbers 100, four medium diagonals 340 of six integer numbers 100, and four short diagonals 350 of four integer numbers 100.

An integer number 100 within the octagon 120 is an example of an integer number in its correct position. The integer number 100 in its correct position is provided as a clue for the examinee to solve the puzzle. A diagonal sum 360 in the triangles 260 is also a clue. The diagonal sum 360 is equal to the arithmetic sum of the integer numbers 100 contained in the diagonal (340, 350) originating at that triangle 260. Note that the diagonal sums 360 at both ends of each diagonal (340, 350) are the same. A diamond sum 370 within the diamonds 240 is also a clue. The diamond sum 370 is equal to the arithmetic sum of the four integer numbers 100 that share the borders of the diamond 240.

Diagonal sums 360 and diamond sums 370 are examples of aggregated information 390. For this embodiment, these are arithmetic sums, but for other embodiments the aggregation could be any physical combination of indicia whose result is predictable and repeatable (for example, multiplication or other mathematical formulae). Aggregated information 390 (diagonal sums 360 and diamond sums 370, in this embodiment) are additional elements of the puzzle, distinct from the indicia (integer numbers 100 in this embodiment).

The goal of the invention, as constructed in the first embodiment, is to place the integer numbers 1 through 8 (100) in each of the octagons 120 such that no integer number 100 is repeated in any octagon 120, column 310, row 320, or diagonal (330, 340, and 350).

General Description of the Method—FIGS. 4(*a*) and 4(*b*)

FIG. 4(*a*) is a block diagram illustrating a flowchart of the method used to create the first embodiment of the current invention. Although the four stages shown in the flowchart can be performed manually, it is considerably more practical to generate instances using a computer program. The source code listing for the program I used to develop and test the prototype version is included as an appendix.

The first stage, represented by block 40, is to create a valid solution by filling all sixteen octagons 120 in the puzzle grid 200 with integer numbers 100 that meet the basic placement rules of the puzzle.

In the second stage, represented by block 42, an examiner-selected number of integer numbers 100 are removed to provide a variable level of challenge for this instance of the puzzle. There are rules to this removal that must be followed to ensure the instance of the puzzle can have one and only one valid solution.

The third stage, represented by block 44, is to review the puzzle and replace removed integer numbers 100 if certain conditions are met, again to ensure the puzzle can have one and only one valid solution.

The fourth stage, represented by block 46, is to draw the puzzle grid 200. The puzzle grid 200 includes the octagons 120, the diagonal sums 360, the diamond sums 370, and the integer numbers 100 randomly selected to be provided as clues for this instance of the puzzle.

Having described the method in general form, each step (block 40, 42, 44, and 46) will be discussed in greater detail in the following paragraphs.

FIG. 4(*b*) is a flowchart that describes additional detail for the method summarized in FIG. 4(*a*).

The method described below is a text description of the source code used to develop and test the prototype of the first embodiment of the current invention. The source code listing is included as an Appendix.

STAGE 1: Create a Valid Solution—FIG. 4(*a*), Block 40

A practitioner skilled in writing software programs will be able to identify multiple ways to place integer numbers 100 in the octagons 120 of puzzle grid 200 so that no integer numbers 100 are repeated in any octagon 120, column 310, row 320, or diagonal (330, 340, or 350). One option is "brute force", whereby all possible combinations are tried until a solution is found. Another possibility is to maintain state of the loading process and be able to "roll back" when all possible integer numbers 100 are invalid for a given position. The method described below was chosen because it provided a reasonable balance between simplicity and efficiency for generating instances of the first embodiment of the current invention. It should be considered strictly illustrative and not limiting in any way.

During all of the Steps of Stage 1 (FIG. 4(*a*), block 40), it is necessary to keep track of which integer numbers 100 have already been placed in each octagon 120, column 310, row 320, and diagonal (330, 340, and 350). The method coded in the listing in the Appendix maintains arrays for each octagon 120, column 310, row 320, and diagonal (330, 340, and 350) and updates the array membership each time an new integer number 100 is randomly selected.

Step (a)

Fill the Center Four Octagons

1) Randomly select an integer number (1-8) 100 for each of the eight positions (FIG. 2) inside octagon 120 (1,1) (FIG. 2), ensuring that no integer number 100 is repeated within octagon 120 (1,1).
2) Randomly select an integer number (1-8) 100 for each of the eight positions (FIG. 2) inside octagon 120 (1,2) (FIG. 2), ensuring that no integer number 100 is repeated within octagon 120 (1,2) or the row 320 shared with octagon 120 (1,1).
3) Randomly select an integer number (1-8) 100 for each of the eight positions (FIG. 2) inside octagon 120 (2,2) (FIG. 2), ensuring that no integer number 100 is repeated within octagon 120 (2,2), the diagonal 330 shared with octagon 120 (1,1) or the column 310 shared with octagon 120 (1,2).
4) Randomly select an integer number (1-8) 100 for each of the eight positions (FIG. 2) inside octagon 120 (2,1) (FIG. 2), ensuring that no integer number 100 is repeated within octagon 120 (2,1), the diagonal 330 shared with octagon 120 (1,2), the column 310 shared with octagon 120 (1,1), or the row 320 shared with octagon 120 (2,2).
5) If at any time, there is no way to fill a position in the octagon 120 without repeating an integer number 100 in any column 310, row 320, or diagonal 330, 340, 350, then quit, clear all progress made to that point, and start over.

Step (b)

Extend the Center Rows, Center Columns, and Long Diagonals

1) Randomly select an integer number (1-8) 100 for positions 0 and 4 (FIG. 2) inside octagons 120 (0,1) and (3, 1) (FIG. 2), ensuring that no integer number 100 is repeated within the column 310 shared with octagons 120 (1,1) and (2,1).
2) Randomly select an integer number (1-8) 100 for positions 0 and 4 (FIG. 2) inside octagons 120 (0,2) and (3, 2) (FIG. 2), ensuring that no integer number 100 is repeated within the column 310 shared with octagons 120 (1,2) and (2,2).
3) Randomly select an integer number (1-8) 100 for positions 2 and 6 (FIG. 2) inside octagons 120 (1,0) and (1, 3) (FIG. 2), ensuring that no integer number 100 is repeated within the row 320 shared with octagons 120 (1,1) and (1,2).
4) Randomly select an integer number (1-8) 100 for positions 2 and 6 (FIG. 2) inside octagons 120 (2,0) and (2, 3) (FIG. 2), ensuring that no integer number 100 is repeated within the row 320 shared with octagons 120 (2,1) and (2,2).
5) Randomly select an integer number (1-8) 100 for positions 3 and 7 (FIG. 2) inside octagons 120 (0,0) and (3, 3) (FIG. 2), ensuring that no integer number 100 is repeated within the diagonal 330 shared with octagons 120 (1,1) and (2,2).
6) Randomly select an integer number (1-8) 100 for positions 1 and 5 (FIG. 2) inside octagons 120 (3,0) and (0, 3) (FIG.

2), ensuring that no integer number 100 is repeated within the diagonal 330 shared with octagons 120 (1,2) and (2,1).

Step (c)

Fill in the 1st and 4th Columns and 1st and 4th Rows

1) Randomly select an integer number (1-8) 100 for positions 0 and 4 (FIG. 2) inside octagons 120 (0,0), (1,0), (2,0), and (3,0) (FIG. 2), ensuring that no integer number 100 is repeated within the octagon 120 (0,0), (1,0), (2,0), and (3,0) or the column 310 shared by octagons 120 (0,0), (1,0), (2,0), and (3,0).
2) Randomly select an integer number (1-8) 100 for positions 0 and 4 (FIG. 2) inside octagons 120 (0,3), (1,3), (2,3), and (3,3) (FIG. 2), ensuring that no integer number 100 is repeated within the octagon 120 (0,3), (1,3), (2,3), and (3,3) or the column 310 shared by octagons 120 (0,3), (1,3), (2,3), and (3,3).
3) Randomly select an integer number (1-8) 100 for positions 2 and 6 (FIG. 2) inside octagons 120 (0,0), (0,1), (0,2), and (0,3) (FIG. 2), ensuring that no integer number 100 is repeated within the octagon 120 (0,0), (1,0), (2,0), and (3,0) or the row 320 shared by octagons 120 (0,0), (1,0), (2,0), and (3,0).
4) Randomly select an integer number (1-8) 100 for positions 2 and 6 (FIG. 2) inside octagons 120 (3,0), (3,1), (3,2), and (3,3) (FIG. 2), ensuring that no integer number 100 is repeated within the octagon 120 (3,0), (3,1), (3,2), and (3,3) or the row 320 shared by octagons 120 (3,0), (3,1), (3,2), and (3,3).
5) If at any time, there is no way to fill a position in the octagon 120 without repeating an integer number 100 in the octagon 120 column 310, row 320, then quit, clear all progress made to that point, and start over.

Step (d)

Fill in the Diagonals

1) For each octagon 120 (0,1), (0,2), (1,0), (1,3), (2,0), (2,3), (3,1), (3,2) (FIG. 2), randomly select an integer number (1-8) 100 for positions 1 and 5 (FIG. 2) ensuring that no integer number 100 is repeated within the octagon 120 or the diagonal 330, 340, or 350.
2) For each octagon 120 (0,1), (0,2), (1,0), (1,3), (2,0), (2,3), (3,1), (3,2) (FIG. 2), randomly select an integer number (1-8) 100 for positions 3 and 7 (FIG. 2) ensuring that no integer number 100 is repeated within the octagon 120 or the diagonal 330, 340, or 350.
3) If at any time, there is no way to fill a position in the octagon 120 without repeating an integer number 100 in the octagon 120 or the diagonal 330, 340, 350, then quit, clear all progress made to that point, and start over.

Step (e)

Fill in the Corner Octagons

1) Randomly select an integer number (1-8) 100 for positions 1 and 5 (FIG. 2) inside octagons (0,0) and (3, 3) (FIG. 2), ensuring that no integer number 100 is repeated within the octagon 120 (0,0) and (3,3).
2) Randomly select an integer number (1-8) 100 for positions 3 and 7 (FIG. 2) inside octagons (0,3) and (3,0) (FIG. 2), ensuring that no integer number 100 is repeated within the octagon 120 (0,3) and (3,0).

Step (f)

Check for the "V" Condition in Outside Octagons

The purpose of this step is to check for a mathematical anomaly that was discovered during the testing of the prototype of the first embodiment of the current invention. If this anomaly is present in the completed solution, the puzzle cannot be solved completely (there will be more than one acceptable solution and not enough clues to determine which of the multiple answers is correct).

FIG. 5 is a truncated version of a solution grid generated using Stage 1, Steps (a) through (e) that demonstrates an instance of the mathematical anomaly. The anomaly occurs in the form of a "V" 500 formed by four integer numbers 100. The "V" anomaly occurs when, for two adjacent octagons 120, the sum of the two outside numbers 100*a* (closest to the edge of the puzzle grid 200) is equal to the sum of the two inside numbers 100*b* (bordering the shared diamond 240). Solutions with this condition result in puzzles that leave the examinees two acceptable choices for the placement of the numbers 100*a* and 100*b* and no additional clues to definitively determine which of the two solutions is correct.

If the anomaly is found, this method rejects the completed solution, clears all progress made to this point, and starts Stage 1 over again.

Successfully completing Steps (a) through (f) completes Stage 1 (FIG. 4(*a*), block 40) and generates a valid solution grid that conforms to the fundamental requirements of the first embodiment of the current invention.

STAGE 2: Remove Integer Numbers 100 Based on Puzzle Difficulty—FIG. 4(*a*), Block 42

Step (g)

Set Puzzle Difficulty

1) Based on prototype testing of the first embodiment of the current invention, the examinee should be provided at least 47 integer numbers 100 in order to have enough information to solve the puzzle. It is theoretically possible to solve an instance of the puzzle given fewer integers number as clues, but it is not statistically likely.
2) If the examinee is provided with more than 65 integer numbers 100 as clues, the puzzle instance is considerably less challenging. Providing significantly more than 65 integer numbers 100 as clues generates an instance that can be solved "by sight", without considerable thought or logic.
3) This step prompts the examiner (or examinee, potentially) to determine how many of the solution integer numbers 100 will be removed for this instance of the puzzle.

Step (h)

Select Integer Numbers 100 that Must Remain

Based on prototype testing of the first embodiment of the current invention, certain rules must be followed during the removal of solution integer numbers 100 to ensure the resulting instance can have one and only one acceptable solution:

1) For each octagon 120, the integer numbers 100 provided as clues must include at least one of the two horizontal positions (positions 2 and 6, FIG. 2). It does not matter which of the two integer numbers 100 remain, but if one is not provided as a clue, the puzzle will have more than one acceptable solution.

2) For each octagon 120, the integer numbers 100 provided as clues must include at least one of the two vertical positions (positions 0 and 4, FIG. 2). It does not matter which of the two integer numbers 100 remain, but if one is not provided as a clue, the puzzle can have more than one acceptable solution.
3) For the middle octagons (1,1) and (2,2) (FIG. 2), the integer numbers 100 provided as clues must include at least one of the two diagonal positions (positions 1 and 5, FIG. 2). It does not matter which of the two integer numbers 100 remain, but if one is not provided as a clue, the puzzle can have more than one acceptable solution.
4) For the middle octagons (1,2) and (2,1) (FIG. 2), the integer numbers 100 provided as clues must include at least one of the two diagonal positions (positions 3 and 7, FIG. 2). It does not matter which of the two integer numbers 100 remain, but if one is not provided as a clue, the puzzle will have more than one acceptable solution.
5) For the corner octagons (0,0) and (3,3) (FIG. 2), the integer numbers 100 provided as clues must include at least one of the two diagonal positions (positions 1 and 5, FIG. 2). It does not matter which of the two integer numbers 100 remain, but if one is not provided as a clue, the puzzle will have more than one acceptable solution.
6) For the corner octagons (0,3) and (3,0) (FIG. 2), the integer numbers 100 provided as clues must include at least one of the two diagonal positions (positions 3 and 7, FIG. 2). It does not matter which of the two integer numbers 100 remain, but if one is not provided as a clue, the puzzle will have more than one acceptable solution.

The method used by the program I wrote to test the prototype of the first embodiment of the current invention randomly selects and then "marks" the integer numbers that fulfill the requirements described in the previous list, so they will not be removed in the next step.

Step (i)

Remove Unmarked Integer Numbers 100 to Desired Puzzle Difficulty

Based on the puzzle difficulty provided in Step (g), this step randomly selects integer numbers 100 to remove from the solution grid, not choosing from the integer numbers 100 marked during the previous step. The algorithm used by the program I wrote to test the first embodiment of the current invention selected randomly from all unmarked integer numbers, but modifying the algorithm is one of the primary methods for generating other embodiments of the current invention.

STAGE 3: Replace Integer Numbers 100 if Certain Conditions are Met—FIG. 4(*a*), Block 44

Based on prototype testing of the first embodiment of the current invention, two anomalies that allow multiple acceptable solutions can occur if integer numbers 100 are removed in certain patterns. These two steps check for those conditions and replace an integer number 100 as a clue to ensure the instance of the puzzle can have one and only one acceptable solution.

Step (j)

Replace an Integer Number 100 if the "Pocket Problem" Exists

FIG. 6 is a truncated version of a solution grid generated using Steps (a) through (e) which illustrates what I call the "pocket problem". Integer numbers 100*c* from corner octagons 120 (0,0) and 0,3) (FIG. 2) share a column 310 while the matching integer numbers 100*d* are in positions where there is no diagonal sum provided as a clue. With no other clues, the examinee could acceptably reverse the two integer numbers 100 in each octagon 120, allowing multiple acceptable solutions.

In the case where this condition exists in the solution grid, it is not automatically true that the puzzle will have multiple acceptable solutions. Instead, this condition is only a problem if all four of the integer numbers 100*c* and 100*d* have been removed in the previous stage. If even one of the four integer numbers 100*c* or 100*d* is replaced as a clue, this instance can have one and only one acceptable solution.

Therefore, the fix if this condition is found is to randomly provide one of the four integer numbers 100*c* or 100*d* as an additional clue for the examinee.

Step (k)

Replace an Integer Number 100 if all Four Integer Numbers 100 in a Short Diagonal 350 have been Removed During the Previous Stage Based on prototype testing of the first embodiment of the current invention, removing all four integer numbers 100 of any of the four short diagonals 350 greatly increases the likelihood that the instance will allow multiple acceptable solutions.

This step checks to see if all four integer numbers 100 have been removed from any of the four short diagonals 350, and if the condition is found, randomly replaces one integer number 100 as an additional clue for the examinee.

Completing Stages 2 and 3 (FIG. 4(*a*), blocks 42 and 44) results in a fully developed puzzle instance that addresses the known situations that lead to multiple acceptable solutions. The difficulty of the resulting instance can be roughly measured by a count of the integer numbers 100 provided to the examinee as clues.

STAGE 4: Draw the Puzzle Grid 200—FIG. 4(*a*), Block 46

The final stage of the development of the first embodiment of the current invention is to render the puzzle in the form it will be presented to the examinee. Stage 4 includes:

1) Drawing the puzzle grid 200 with the 4×4 pattern of sixteen octagons 120, including the diamonds 240 and the triangles 260.
2) For each diamond 240, generating the diamond sum 370 by totaling the four integer numbers 100 that border the diamond 240.
3) For each diamond 240, printing the calculated diamond sum 370 within the diamond 240.
4) For the triangles 260 at both ends of a short diagonal 350, generating the diagonal sum 360 by totaling the four integer numbers 100 that are members of the intervening short diagonal 350.
5) For the triangles 260 at both ends of a medium diagonal 340, generating the diagonal sum 360 by totaling the six integer numbers 100 that are members of the intervening medium diagonal 340.
6) For each triangle 260, printing the calculated diagonal sum 360 within the triangle 260.
7) Printing, in the correct positions (FIG. 2), the integer numbers 100 that have been selected in Stages 2 and 3 (FIG. 4(*a*), blocks 42 and 44) to be provided to the examinee as clues for solving this instance of the puzzle.

The software program included as an Appendix, which I used to generate prototype puzzles for testing, also prints a solution array and instructions for solving the puzzle on each page. These additions, while useful for the testing of the prototype, are for illustration purposes only and should not be considered a required part of the current invention.

Operation

First Embodiment—FIGS. 7-9

The operation of the first embodiment of the current invention is encompassed in the following directions, provided to an examinee along with an instance of the puzzle:

"Place the numbers 1 to 8 in each of the octagons such that no number is repeated in any row, column, diagonal, or octagon. The two-digit numbers along the edges, top, and bottom are the sums of the numbers in the diagonal that begins or ends at that number. The number in each diamond is the sum of the numbers of each of the four faces that border that diamond. The numbers that border a diamond can be repeated."

There are many different techniques that can be applied to solve a puzzle instance of the first embodiment of the current invention. The next section will demonstrate a variety of the techniques an examinee can use to solve an instance of the puzzle, referring to FIGS. 7-8. The techniques described here are for illustration purposes only and are not intended to be exhaustive of the many logical and arithmetic techniques that can be used by an examinee to solve an instance of the puzzle.

FIG. 7(*a*) is a truncated version of an instance of the puzzle as it would be presented to an examinee. FIG. 7(*b*) demonstrates the most straightforward technique for solving the first embodiment of the current invention. Based on the rule that each integer number (1-8) 100 can only appear once in each octagon 120, and given the three "6"s 100*e* that appear in the top three octagons 120, it follows that the number "6" for the column 310 marked by the dotted line can only be placed in the circled position 100*f*. This technique can be used to correctly place integer numbers 100 in columns 310, rows 320, and major diagonals 330.

FIG. 7(*b*) also demonstrates a second technique an examinee can use to find the correct position of an integer number 100. The three "3"s 100*g* prevent the number "3" from being in any position except circled position 100*h* in the third octagon 120 from the top.

FIG. 8(*a*) is a truncated version of an instance of the puzzle as it would be presented to an examinee. Using FIG. 8(*b*), focus on the diamond sum 370 with the value "26". Integer numbers 100 for two of the bordering faces are provided ("8" and "4"), so the sum of the other two faces must equal "14" (26−12=14). Choosing only from the numbers 1 through 8, there are only two possible combinations, "6" and "8" or "7" and "7", but because of the "7" in the upper right octagon 120, the two numbers must be "6" and "8". Since there is already a "6" in the upper right octagon 120, the correct combination must be the "8" in the upper right octagon 120 and the "6" in the lower right octagon 120 (as shown in FIG. 8(*b*)).

Now focus on the diagonal sum 360 with the value "17". Two numbers in the short diagonal 350 have been determined ("8" and "6"), so the sum of the other two numbers in the short diagonal 350 must equal "3" (17−8−6=3). Choosing only from the numbers 1 through 8, there is only one possible combination, "1" and "2". Since there is already a "2" in the lower right octagon 120, the correct combination must be the "2" in the upper left octagon 120 and the "1" in the lower right octagon 120.

A key technique for solving along medium diagonals 340 and short diagonals 350 is to reduce the candidate integer numbers 120 for that diagonal based on examining the limited number of possible combinations that can add up to a given diagonal sum 360. For example, if a medium diagonal 340 has a diagonal sum 360 equal to "31", there are only two combinations of six non-repeating integer numbers 100, selected from the numbers 1 through 8, that add up to "31" (1-4-5-6-7-8 and 2-3-5-6-7-8). As another example, a short diagonal 350 that has a diagonal sum 360 of "11" has only one valid combination of four integer numbers 100, selected from the numbers 1 through 8 (1-2-3-5).

This "addend" technique is valid for both medium diagonals 340 and short diagonals 350. The placement of integer numbers 100 in the octagons 120 that include the diagonal (340 or 350) can often be used to determine which of the combinational possibilities is correct. This in turn reduces the options for selecting and positioning integer numbers 100 in the diagonal (340 or 350) and in the corresponding octagons 120.

Another useful technique is to narrow down candidate integer numbers 100 for a given position in an octagon 120. Several techniques for solving an instance of the puzzle are based on the combinations of numbers left in an octagon as impossible combinations are removed. For example, if two positions within an octagon 120 can be narrowed down to the same two integer numbers (say "2" and "4"), then neither a "2" nor a "4" can be in any of the other positions in the same octagon 120. This technique works for octagons 120, columns 310, rows 320, or major diagonals 330.

FIG. 9 is a fully-functioning example of the first embodiment of the present invention. FIG. 9 represents what a single instance of this embodiment of the invention would look like to an examinee.

Description and Use of Alternative Embodiments

Computerized Embodiments

While the first embodiment has been expressed as a printed instance intended to allow an examinee to solve the puzzle using a pencil, the structure, concepts, and design principles are extremely well suited for implementation in electronic forms, including but not limited to an installed computer game, a plug-in game console, or an interactive web-based application delivered via browser, personal digital assistant, or hand-held phone. Examinee interaction with a computer-based version of the present invention would be very different, as the computer can report back to the examinee in real time if guesses are incorrect or provide a hint at the request of the examinee. Another useful feature would be an "undo" feature that allows an examinee to back out numbers to recover from a mistake.

Board Game Version. Another physical embodiment of the puzzle is as an electronic board game, with a computer engine generating puzzles and an electronic mechanism that allows players to assign solutions to empty positions in the puzzle. One possible use of such an electronic version would be for two players to alternate assigning numbers to positions on the board and being scored on whether the assignments are correct.

Alternative Algorithms. The first embodiment described in the previous sections used a fully random algorithm during the "Remove integer numbers 100 based on puzzle difficulty (42)" (FIG. 4(*a*), Stage 2) of the puzzle generation process. Other algorithms could be used instead, including algorithms based on a specific area of the puzzle grid, a specific integer number or group of integer numbers, or the symmetry of the integer numbers 100 provided as clues.

Derivative Physical Structures. It is possible that many of the same characteristics, solving techniques, and advantages attributed to the first embodiment could be inherent in similar structures based on other geometric shapes, such as squares, circles, decagons, or dodecagons. My investigations of these alternatives suggest that they are not as straightforward to work with as octagons, but it may be possible to create a derivative puzzle that follows the same general form using other geometric shapes as base components. Another variation of the physical structure is to use indicia other than numbers. For example, it is possible eight unique letters could be used instead, as long as the examiner provides a method for "summing" the letters to support the concept of aggregated information.

Variable Clues. Another variation of the puzzle described in the first embodiment is an instance that removes some of the aggregated information 390 (diagonal sums 360 and/or diamond sums 370, or their equivalents). I experimented with this type of version, but I found it necessary to provide many additional integer numbers 100 in order to make up for the lost information that would have been provided by the missing clues. Even so, this is a valid alternative that could be implemented to provide examinees with a different "twist" on the basic embodiment.

The embodiments proposed above are similar to general variations that have already been applied and marketed for other puzzles that are currently popular (particularly Sudoku). For that reason, I believe the modifications and alternative arrangements described are easily understood by a person skilled in the art and are well within the spirit and scope of the appended claims, which should be accorded the broadest interpretation so as to encompass all such modifications and variations.

CONCLUSION, RAMIFICATIONS, AND SCOPE

Accordingly, the reader will see that, according to one embodiment of the invention, I have provided a superior new form of puzzle that combines the basic concepts of several puzzles available in the prior art to form a more broadly challenging puzzle that requires a wider variety of techniques to solve.

While the above description contains many specificities, these should not be construed as limitations on the scope of any embodiment, but as exemplifications of the first embodiment thereof. Many other ramifications and variations are possible within the teachings of the various embodiments. For example, computerized versions, board game versions, different algorithms used to generate instances, variations of provided clues, and different base geometric shapes or indicia are other possible ramifications and variations.

Thus the scope of the invention should be determined by the appended claims and their legal equivalents, and not by the examples given.

I claim:

1. A puzzle, comprising:

(a) a plurality of geometric shapes arranged contiguously;

(b) linear constructs formed in the alignment of said geometric shapes;

(c) empty spaces formed in the intersections of said geometric shapes;

(d) indicia, selected from a predetermined, limited set, placed without repetition in said geometric shapes and aligned with said linear constructs, a predetermined subset of said indicia being provided to an examinee as clues for solving said puzzle;

(e) aggregated information provided in said empty spaces about said indicia bordering said empty spaces provided to an examinee as clues for solving said puzzle; and (f) aggregated information written into said puzzle about said indicia residing in said linear constructs provided to an examinee as clues for solving said puzzle, wherein said geometric shapes are sixteen octagons arranged in a four-by-four grid, wherein the indicia are numbers selected from the integers 1 through 8, and said numbers are placed in said octagons so as to align, without repetition, with rows, columns, and diagonals.

2. The puzzle set forth in claim 1, wherein said linear constructs are rows, columns, and diagonals formed in the alignment of said sixteen octagons arranged in said four-by-four grid.

3. The puzzle set forth in claim 1, wherein said empty spaces are diamonds formed in the intersections of said sixteen octagons arranged in said four-by-four grid.

4. The puzzle set forth in claim 1, wherein said numbers are placed by the examiner, without repetition, in said sixteen octagons.

5. The puzzle set forth in claim 1, wherein a predetermined subset of said numbers are provided to an examinee as dues for solving said puzzle.

6. The puzzle set forth in claim 1, wherein said aggregated information about said indicia bordering said empty spaces is the sum of said numbers immediately bordering said empty spaces.

7. The puzzle set forth in claim 1, wherein said aggregated information about said indicia residing in said linear constructs is the sum of said numbers that are members of said diagonal.

8. A puzzle, comprising:

(a) sixteen octagons 120 arranged contiguously in a four by four grid such that the following structures are formed:

(1) four rows 320 each passing through four said octagons;

(2) four columns 310, each passing through four said octagons;

(3) two long diagonals 330, each passing through four said octagons;

(4) four medium diagonals 340, each passing through three said octagons;

(5) four short diagonals 350, each passing through two said octagons (6) nine diamonds 240 formed by the intersection of four contiguous said octagons;

(7) sixteen triangles 260 formed by bisecting the spaces where middle outside said octagons intersect;

(b) 128 integer numbers 100 selected from the integer numbers 1 through 8 placed without repetition in sixteen said octagons 120 and aligned, without repetition, with said rows, columns, and diagonals, a predetermined subset of said integer numbers 100 being provided to an examinee as clues for solving said puzzle;

(c) a diamond sum 370 provided in said diamonds 240 calculated as the sum of four said integer numbers immediately bordering said diamond provided to the examinee as clues for solving said puzzle;

(d) a diagonal sum 360 provided in each said triangle 260 calculated as the sum of said integer numbers that are members of said diagonal (340, 350) that intersects said triangle 260.

* * * * *